US005809157A

United States Patent [19]

Grumazescu

[11] Patent Number: 5,809,157

[45] Date of Patent: Sep. 15, 1998

[54] ELECTROMAGNETIC LINEAR DRIVE

[75] Inventor: Mihai Grumazescu, Fullerton, Calif.

[73] Assignee: Victor Lavrov, Anaheim, Calif.

[21] Appl. No.: 629,787

[22] Filed: Apr. 9, 1996

[51] Int. Cl.[6] ..... H04R 25/00

[52] U.S. Cl. ..... 381/199; 381/201; 310/13; 335/229; 335/228

[58] Field of Search ..... 381/199, 194, 381/201; 335/228, 222, 229; 310/20, 13

[56] References Cited

U.S. PATENT DOCUMENTS

| | | | |
|---|---|---|---|
| 2,951,190 | 8/1960 | Baermann | 381/201 |
| 4,000,381 | 12/1976 | Plice et al. | 381/199 |
| 4,010,334 | 3/1977 | Demeter | 381/199 |
| 4,237,347 | 12/1980 | Burundukov et al. | 381/192 |
| 4,419,643 | 12/1983 | Ojima et al. | 335/234 |
| 4,422,060 | 12/1983 | Mastsumoto et al. | 335/256 |
| 4,604,599 | 8/1986 | Koehler | 335/230 |
| 4,782,315 | 11/1988 | Bataille et al. | 335/234 |
| 5,268,662 | 12/1993 | Uehtsuhara et al. | 335/229 |
| 5,434,549 | 7/1995 | Hirabayashi et al. | 335/229 |

*Primary Examiner*—Curtis A. Kuntz
*Assistant Examiner*—Rexford N. Barnie

[57] ABSTRACT

An electromagnetic linear drive has a stationary unit, a mobile unit centered and coaxially placed with respect to the stationary unit and an enclosing assembly made of diamagnetic material to support and protect the stationary unit and the mobile unit. The stationary unit contains a coil, wound around a bobbin made of non-conductive and diamagnetic material including a stationary magnet coaxially attached to the lateral face of the bobbin. The mobile unit includes a mobile magnet fastened to a shaft made of diamagnetic material which holds, positions and further transfer the linear motion of the mobile magnet to the driven device. Two stationary units are used to obtain controlled movement in both direction. The permanent magnets are magnetized in the direction of their thickness, coaxially positioned and arranged to repulse each other. The coils are connected in series with the magnetic fields opposed. The mobile unit is moved by synergetic attraction and repulsive forces of a bi-directional rectangular electric current, generated by a bridge type circuit through the coils of the stationary units. This invention has higher output force and operating frequency created by eliminating ferromagnetic materials. This linear drive directly converts electric energy to linear motion. It can be used where precise movement is required or in applications such as pumps, robotics, loudspeakers and underwater communications.

18 Claims, 5 Drawing Sheets

ELECTROMAGNETIC LINEAR DRIVE

FIELD AND BACKGROUND OF THE INVENTION

This invention relates to an electromagnetic linear drive used to drive piston or diaphragm pumps as well as a loudspeaker. This device can be also used where precise linear motion or positioning is required like robotics, instruments, flow control, etc.

An important part of research and development work particularly for piston pumps construction, is concerned with the creation of a simple, lightweight, compact and efficient linear drive to drive the piston, having low power consumption and good output force. In some piston pumps the linear motion of the piston is obtained by transforming the circular motion of an electric motor using a crank and connecting rod assembly. The main disadvantage of this method is that the overall efficiency of the pump is adversely affected by the efficiency of the crank and connecting rod assembly. Another solution is the use of an electromagnet with a mobile element made of ferromagnetic material driving the piston or the diaphragm of a pump oscillating at the frequency of 50–60 Hz of the AC power source. This solution has the disadvantage of low power output and limited travel of the mobile element, resulting in low flow and low pressure capability.

In U.S. Pat. No. 5,268,662, there is disclosed a plunger type electromagnet used to control valves. It is a classical method to use a plunger type electromagnet to obtain direct linear motion. This method has negative characteristics affecting its overall efficiency like: its operating frequency is limited by its ferromagnetic core, has magnetic losses generated by Foucault currents and heat, has an uncontrolled and small linear travel, it needs additional suppression circuits to function properly, and has low power output compared with its mass.

SUMMARY OF THE INVENTION

The main goal of this invention is to create a more efficient and simple electromagnetic drive, that will convert the electrical energy to mechanical energy, delivering a controlled linear motion output. Some of the distinct features of the present invention resulting in numerous advantages are described below:

it has no magnetic circuit made of ferromagnetic material, which reduces its total mass and magnetic losses due to Foucault currents and the heat;

its mobile element is energetically active, not made of ferromagnetic materials;

its coils are energized by bi-directional pulses;

its upper frequency of operation is limited only by the mechanical inertia of the mobile element;

its linear travel output is up to 10 times greater than a plunger type electromagnet;

its mobile element is driven with the same force in both directions;

when its coils are not energized, the mobile element is centered by magnetic forces;

the movement of its mobile element can be precisely controlled by a common electronic circuit to any position in both directions;

its low inductance coils are energized using very simple electronic circuits without the need of suppression diodes or resistors. Other objects and advantages of the present invention will appear more clearly from the following description accompanied by drawings wherein like numerals refer to alike or equivalent parts.

DETAILED DESCRIPTION OF THE PREFERED EMBODIMENTS

The electromagnetic linear drive according to the present invention consists of a plurality of units interacting together to produce work using a combination of magnetic forces.

Figure 1:
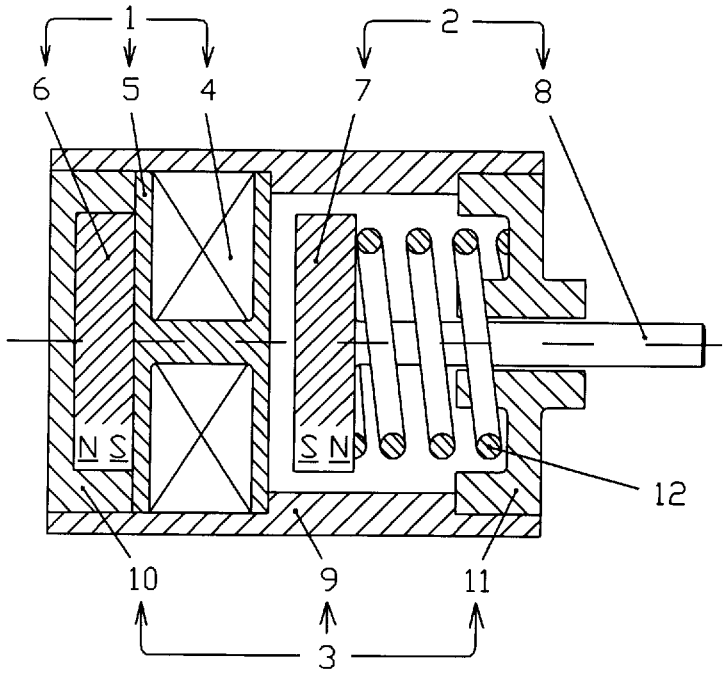
FIG. 1 is a cross-sectional view showing a simplified embodiment according to the invention, where the mobile element is driven only in one direction.

In the first preferred embodiment shown in FIG. 1, the electromagnetic linear drive is comprised of a stationary unit 1, a mobile unit 2, and an enclosing assembly 3.

The stationary unit 1, consists of a coil means 4 hereinafter referred to interchangeably as such or simply "the coil", wound around a bobbin means 5 hereinafter referred to interchangeably as such or simply "the bobbin",and a stationary magnet means 6 hereinafter referred to interchangeably as such or simply "the stationary magnet.". The stationary magnet 6 is concentric and firmly attached to the lateral face of the bobbin 5. The bobbin 5 is made of a non-conductive and diamagnetic material. Of course the coil may be used without a bobbin so that reference to the bobbin also means a coil with no bobbin.

The mobile unit 2, is comprised of a mobile magnet means 7, hereinafter referred to interchangeably as such or simply "the mobile magnet," fastened to a linear motion executing means which may be simply a shaft 8.

The enclosing assembly 3, consists of a main housing 9, an end cover 10 and end cover 11.

The main housing 9, holds together the entire apparatus and has at one end the end cover 10 to support and align the stationary unit 1 and at the other end the end cover 11 to provide support and sliding capability to the shaft 8. The end cover 11, also provides support for a compression spring 12.

The main housing 9, the end cover 10, the end cover 11, the shaft 8, the compression spring 12 and the bobbin 5, are all made of diamagnetic materials.

The stationary magnet 6 and the mobile magnet 7 are made of high grade magnetic material and are of an annular shape magnetized in the direction of the thickness of the annulus. The stationary magnet 6 and the mobile magnet 7 as shown in FIG. 1, are aligned and positioned in such a manner to repulse each other, with their magnetic polarities reversed and corresponding to N-S and S-N.

When coil 4 is not energized the mobile magnet 7 rests on the lateral face of the bobbin 5, held by the action of the compression spring 12 with enough force to balance the magnetic repulsive force existing between the stationary magnet 6 and the mobile magnet 7.

When coil 4 is energized by DC current, a magnetic flux is generated and added to the magnetic flux of the stationary magnet 6 to repulse the mobile magnet 7, creating work. This constitutes the active travel of the electromagnetic linear drive.

When the DC current is switched off the mobile magnet 7 is returned by the compression spring 12 to the lateral face of bobbin 5. To obtain a repetitive motion the DC current must be chopped with the desired frequency. The coil 4, has low inductance and no ferromagnetic core making possible higher DC current chopping rates. Even at higher currents, values will not reach the coercive force needed to demagnetize the permanent magnets.

Figure 2:
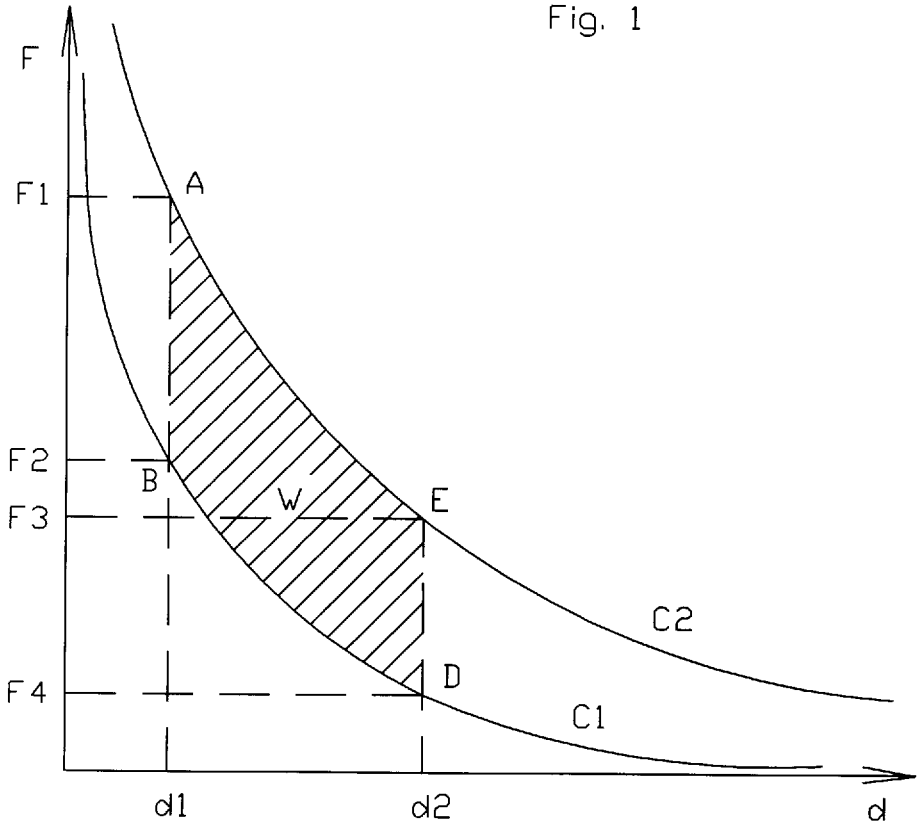
FIG. 2 is a graph showing the static force as a function of distance acting upon the mobile element of the linear drive shown in FIG. 1, in two situations; when it is using the extra energy offered by the permanent magnet, and when it is not using it.

The graph shown in FIG. 2, illustrates the characteristic curve of the magnetic force generated between the stationary magnet 6 and mobile magnet 7, in two different situation and represented by well known hyperbolic curves, where F is the force and d is distance.

The curve C1 represents the magnetic repulsive force generated only by the coil 4, against the mobile magnet 7, without the repulsive force of the stationary magnet 6. Considering the travel of the mobile magnet 7 between the points d1 and d2 the corresponding values of the magnetic repulsive force created only by coil 4 is between F2 and F4, points B and D on the graph.

The curve C2 represents the magnetic repulsive force generated when the stationary magnet 6 is attached to the coil 4, using the same current value. Considering the travel of the mobile magnet 7 between the same points d1 and d2 the corresponding values of the new magnetic repulsive force created by the combined magnetic fluxes of the stationary magnet 6 and coil 4 is between F1 and F3, points A and E on the graph.

The A-B-D-E area on the graph represents the extra work W gained due to the stationary magnet 6.

This arrangement of a mobile magnet 7 repulsed by the coil 4 attached to the stationary magnet 6 is capable of extracting energy from the stationary magnet 6 each time the coil 4 is energized.

Figure 3:
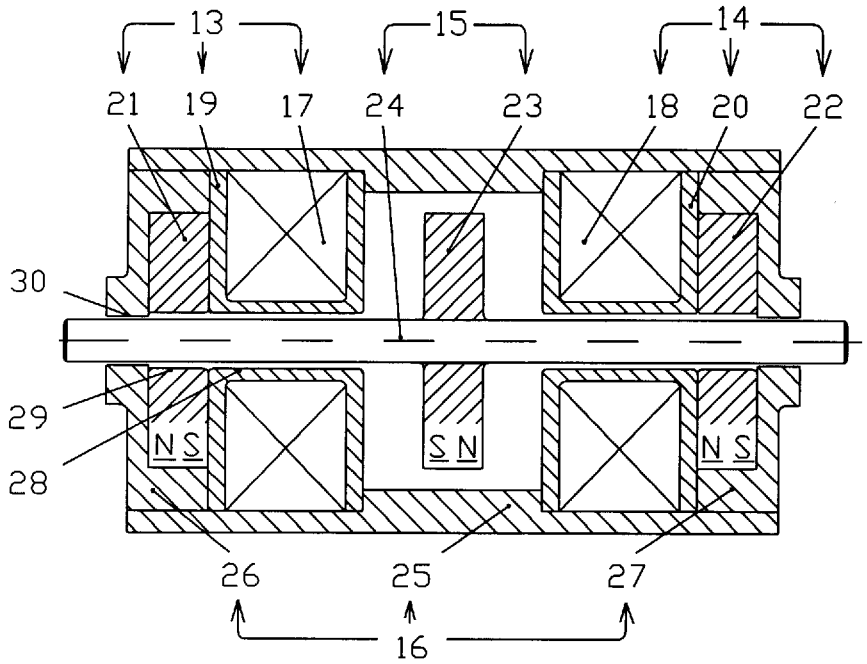
FIG. 3 is a cross-sectional view of a second embodiment of the electromagnetic linear drive able to drive the mobile element in both directions.

In a second preferred embodiment shown in FIG. 3, the electromagnetic linear drive is comprised of a stationary unit 13 and 14, a mobile unit 15 and an enclosing assembly 16.

The stationary unit 13 and 14, consists of a coil 17 and 18, wound around a pair of bobbins 19 and 20 and stationary magnets 21 and 22. The stationary magnets 21 and 22 are concentric and firmly attached to the lateral face of the bobbins 19 and 20 respectively. The bobbins 19 and 20 are made of a non-conductive material.

The mobile unit 15, comprises a mobile magnet 23, permanently fastened on a shaft 24.

The enclosing assembly 16, has a main housing 25 and end covers 26 and 27. The bobbins 19 and 20 are provided with a hollow area 28 and the stationary magnets 21 and 22, with a hole 29, to allow unobstructed passage of shaft 24. The stationary units 13 and 14 are placed at both ends of the main housing 25, fastened by the end covers 26 and 27. The shaft 24, is extended in both directions of the mobile magnet 23 and slides through a bearing area 30, provided on the end covers 26 and 27. All parts are made of diamagnetic materials with the exception of the stationary magnets 21 and 22 and the mobile magnet 23.

The magnetic polarity arrangement of the stationary magnet 21, mobile magnet 23 and stationary magnet 22 as illustrated in FIG. 3, is N-S;S-N;N-S OR S-N;N-S;S-N. As a result of this arrangement the mobile magnet 23 is centered by the magnetic repulsive forces of the stationary magnets 21 and 22. The stationary magnets 21 and 22 and the mobile magnet 23, are made of high grade magnetic materials and may have the same size and characteristics. The coils 17 and 18, are connected in series and in such a way that their magnetic fluxes are opposed when energized.

When it is necessary to move the shaft 24 from left to right in FIG. 3, two simultaneous processes take place. The mobile magnet 23 is repulsed by the added magnetic fluxes of the coil 17 and stationary magnet 21 and at the same time the mobile magnet 23 is attracted by the magnetic flux of the coil 18, which must be powerful enough to overcome the magnetic flux generated by the stationary magnet 22 and not to interact with the magnetic flux of the stationary magnet 22. This process is possible only by exceeding a certain threshold of the electric current. The coils 17 and 18, are designed to store a magnetic energy equivalent to 2–3% of the maximum magnetic energy of each stationary magnet 21 and 22.

Figure 4:
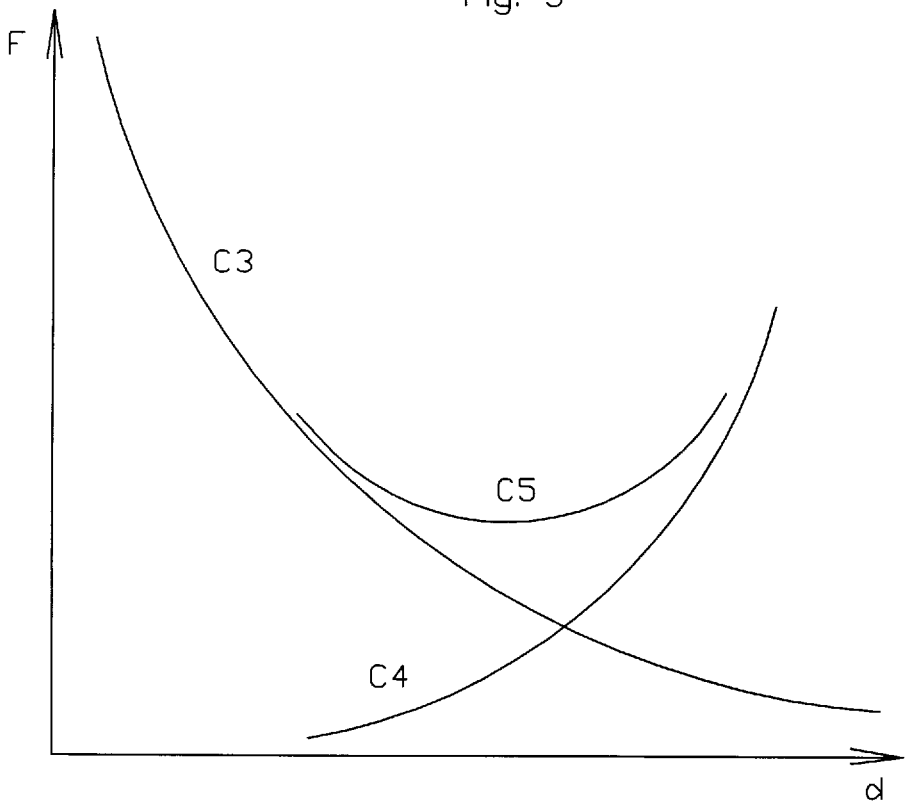
FIG. 4 is a graph showing the static forces as a function of distance acting upon the mobile element of the electromagnetic linear drive shown in FIG. 3, resulting from the addition of the independent forces due to the two static acting elements.

The graph shown in FIG. 4, illustrates the characteristic curves of the combined magnetic forces acting upon the mobile magnet 23 in different situations and represented by well known hyperbolic curves, where F is the force and d is distance. The C3 curve represents the static repulsive force which results from the combined magnetic forces of the stationary magnet 21 and the coil 17 acting upon the mobile magnet 23. The static attractive force resulting from the magnetic flux of the coil 18, and acting upon the mobile magnet 23, is represented by the curve C4, when the mobile magnet 23 is traveling from left to right of FIG. 3.

One may observe that the amplitude of the attractive force represented by curve C4 is lower than the repulsive force represented by the curve C3. This is explained by the loss of a portion of the total magnetic energy generated by the coil 18 to overcome the repulsive force of the stationary magnet 22.

Figure 5:
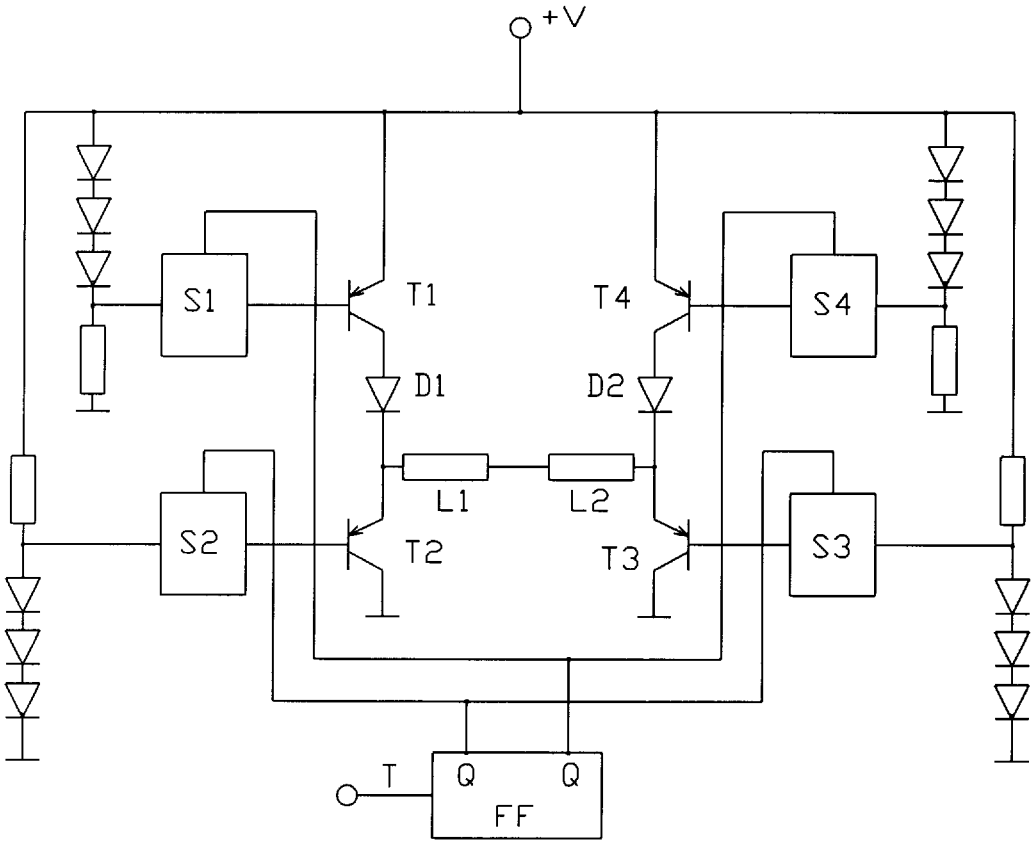
FIG. 5 is an illustrative electronic circuit for operating the electromagnetic linear drive shown in FIG. 3.

According to the present invention the electromagnetic drive uses an electronic circuit like the one illustrated in FIG. 5, to energize coils 17 and 18. It is a commonly used bridge-type circuit and comprises power transistors T1, T3, T3 and T4, bilateral transmission gates S1, S2, S3 and S4, diodes D1 and D2, a flip-flop FF, loads L1 and L2 representing the coils 17 and 18 from FIG. 3 and other parts usually present in such circuits. This electronic circuit can alternately reverse the polarity of DC current supplied by a power source +V on the load L1 connected in series with the load L2. When the power transistors T1 and T3 are switched-on, the current flow passes through transistor T1, diode D1, load L1 and L2 and through transistor T3 to the ground, the transistors T2 and T4 are switched-off. When the power transistor T2 and T4 are switched-on, the current flow passes through transistor T4, diode D2, load L2 and L1 and through transistor T2 to the ground, the transistors T1 and T3 are switched-off.

This occurs each time a positive-going impulse is present at input T of the flip-flop FF, and an output Q is generated to oppositely switch the bilateral transmission gates S1 and S3 and also S2 and S4. Each transmission gate is switching by the corresponding power transistor. Diodes D1 and D2 are necessary to isolate one circuit branch function from the other in the bridge circuit. If all bilateral transmission gates and the flip-flop used are CMOS type, the value of the DC current passing through the loads L1 and L2 may be adjusted by the voltage value of the DC power source +V in a 15V range. Because of the low inductance and the lack of a ferromagnetic core in the coils 17 and 18, there is no need for suppression resistors or diodes and the power losses due to the switching are very low. A good rectangular shape of the load current is very important for the electromagnetic linear drive to work properly according to the present invention. Assuming that at the input T pulses unsuspected with equal on-off periods, the mobile unit 2 of the electromagnetic drive, will travel back-and-forth in a synchronous linear motion. It will be observed that the higher the frequency, the shorter the amplitude of the movement around the initial centered position of the mobile magnet 23. Generally speaking, for a given mass of the moving parts of the invention, a critical frequency may be found where no motion can be observed but a characteristic sound may be heard. By changing only the on-off periods of the input signal and keeping the frequency constant, a smooth movement of the mobile unit 15, to the left or to the right of the initial centered position, can be obtained.

Figure 6:
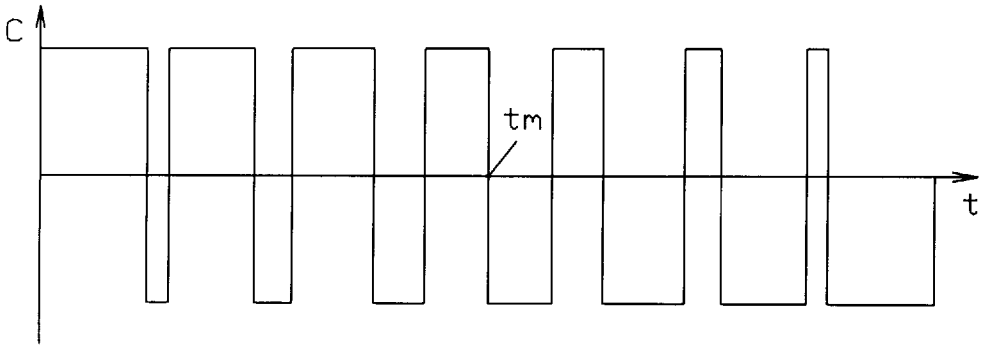
FIG. 6 is the oscillogram of the current through the coils of the electromagnetic linear drive showing the principle of the motion control of the mobile element.

FIG. 6, illustrates an oscillogram of a current C, passing through the loads L1 and L2, over a period of time t. The moment when the on-off periods are equal and the mobile element is at the middle position is represented by tm.

The input signal has the same shape as the positive half of current C and is a voltage CMOS compatible signal. It may be easily processed by a function generator or a processor. In the example shown in FIG. 6, the mobile element is traveling from left to right of FIG. 3 and the retaining force has the same shape as the curve C5 from FIG. 4, but with a lower amplitude. It is possible to obtain a family of curves placed under C5, the higher the frequency of operation, the lower the amplitude of the retaining force. When the mobile element reaches the right end of its travel, the input signal is suddenly passed through an inverter causing that mobile element to be repulsed back with the same force. This reaction can be represented by a curve obtained by mirroring the curve C5.

The travel and output force of this electromagnetic drive can be adjusted by processing the input signal. The critical frequency necessary to center the mobile unit 15 is determined by allowing for the inertia of the mechanical load to which it is coupled.

The electromagnetic drive according to this invention can be used where precise linear motion is required including diaphragm and piston pumps, fuel pumps, refrigerator compressors, double-effect volumetric pumps, in robotics, flow control, medical equipment, car industry, etc.

Figure 7:
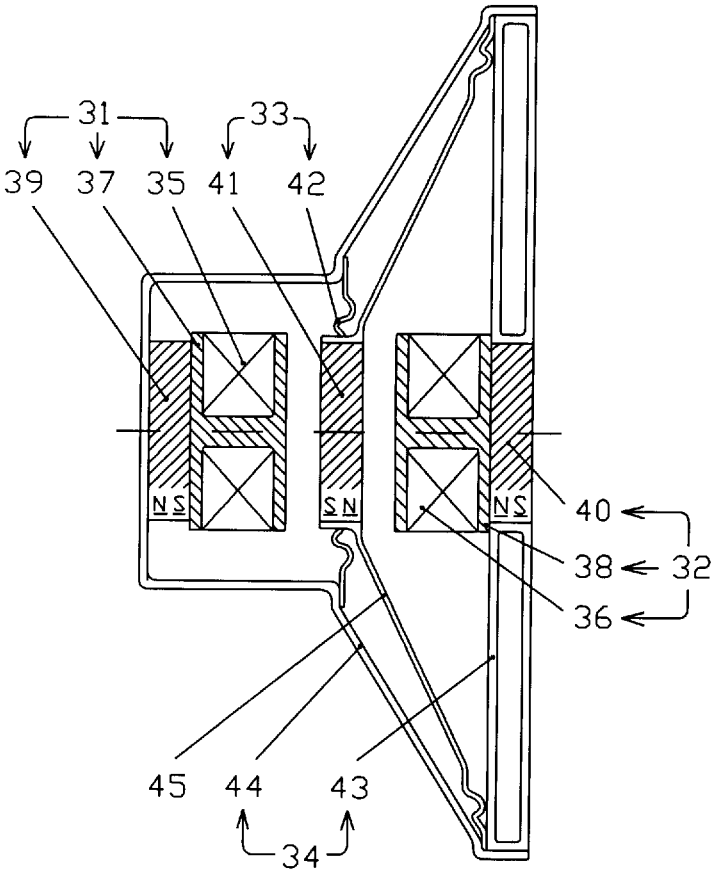
FIG. 7 is a cross-sectional view of a third embodiment of the electromagnetic linear drive as applied to a loudspeaker.

The electromagnetic linear drive in a third preferred embodiment is shown in FIG. 7, representing a loudspeaker.

The loudspeaker includes stationary units 31 and 32, a mobile unit 33 and an enclosing assembly 34.

The stationary units 31 and 32, consist of a coil 35 or 36, wound around a bobbin 37 or 38 and stationary magnets 39 and 40. The stationary magnets 39 and 40 are concentric and firmly attached to the lateral face of the bobbins 37 and 38 respectively. The bobbins 37 and 38 are made of a non-conductive and diamagnetic material.

The mobile unit 33, comprises a mobile magnet 41, supported and coaxially arranged between the stationary units 31 and 32 by the linear motion executing means, in this case an elastic element 42.

The stationary unit 32 is firmly attached and positioned by a spoked frame 43, connected with a housing 44. The mobile magnet 41 is fastened to a diaphragm 45. The stationary magnets 39 and 40 and the mobile magnet 41, are annular permanent magnets, magnetized in the direction of their thickness and arranged in the same manner as in FIG. 3. The housing 44 and the spoked frame 43 can by made of light diamagnetic metals or plastic materials. The elastic element 42 is made of diamagnetic material and the bobbins 37 and 38 are made of non-conductive material. This embodiment of the present invention contains the same functional elements as the embodiment presented in FIG. 3, where the stationary units 13 and 14 are replaced by stationary units 31 and 32, the mobile unit 15 is replaced by mobile unit 33 and the enclosing assembly 16, is replaced by the enclosing assembly 34. The rod 24 is missing and replaced by the diaphragm 45. The mobile magnet 41 is 2–3 times lighter than the mobile coil of a common loudspeaker and its stored magnetic energy is 100,000 times greater. Making it possible to produce lighter and more efficient speakers for higher frequency response. Another advantage of this solution is the absence of the flexible wires necessary to energize the mobile coil of a common speaker, which can break.

An important advantage of the loudspeaker according to the present invention is the fact that it is driven only by bi-directional rectangular current pulses produced by a circuit like the one shown in FIG. 5. For better sound reproduction, an efficient class D electronic amplifier can be used.

When a loudspeaker according to the present invention, is connected to an adapted class D electronic amplifier (mentioned above), the result in a remarkably lightweight and cost effective sound system. The loudspeaker presented is 2–3 times more efficient than a common loudspeaker of the same size, is more reliable and it has a very simple structure. It may be used in megaphones, horns, sirens, portable radios, airborne electronics, in high power sound systems for show business and for other applications where a loudspeaker is used.

Figure 8:
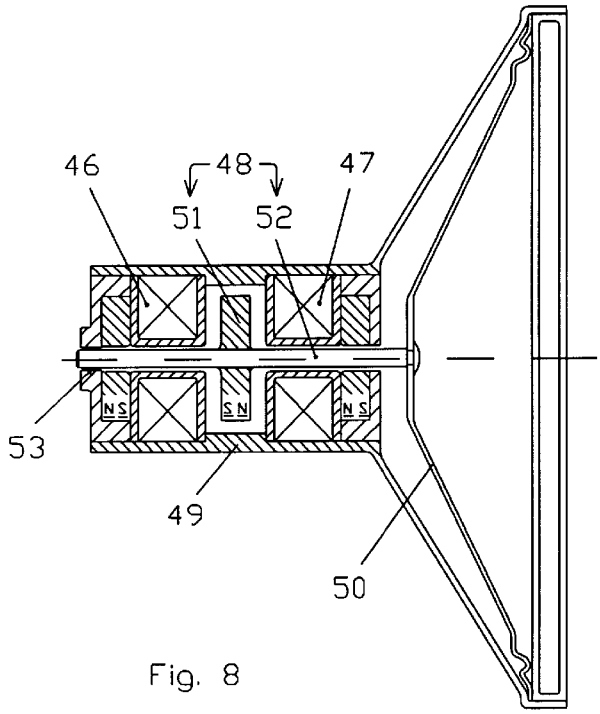
FIG. 8 is a cross-sectional view of the electromagnetic linear drive in an other embodiment of a speaker.

In another example we see the embodiment shown in FIG. 8, where the loudspeaker has all the main components of the loudspeaker described in FIG. 7, but in a different arrangement. The loudspeaker includes stationary units 46 and 47, a mobile unit 48 and an enclosing assembly 49, all situated on one side of a diaphragm 50. The mobile unit 48 includes a mobile magnet 51 and a shaft 52. The shaft 52 is firmly attached to the diaphragm 50 at one end and is supported and guided by a bearing area 53 at the other end. This loudspeaker is best used in low frequency applications, offering the possibility of increasing the size of the mobile magnet 51 to obtain more power, limited only by its mechanical inertia.

Figure 9:
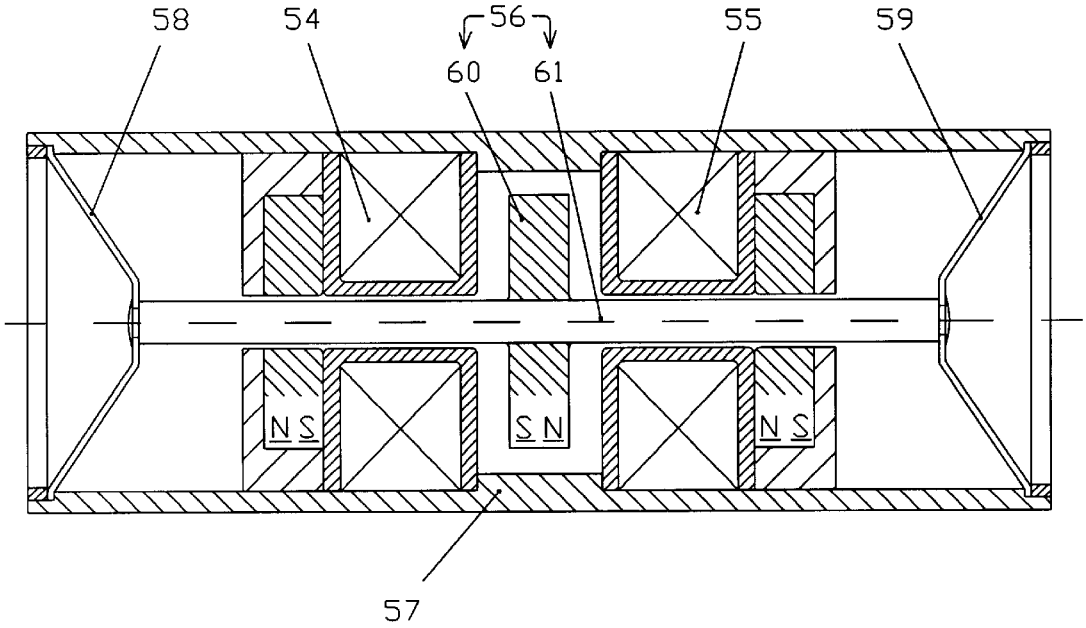
FIG. 9 is a cross-sectional view of an other embodiment of the electromagnetic linear drive as applied to a bi-directional speaker.

The electromagnetic linear drive in another preferred embodiment is shown in FIG. 9 and illustrates a bi-directional speaker that comprises stationary units 54 and 55, a mobile unit 56 and an enclosing assembly 57. The stationary units 54 and 55 and the mobile unit 56 are all situated between a diaphragm 58 and 59. The mobile unit 56 comprises a mobile magnet 60 permanently fastened to a shaft 61. The shaft 61 is attached at one end to the diaphragm 58 and at the other end to the diaphragm 59. The diaphragms 58 and 59 offer support and alignment for the shaft 61. The shaft 61 moves freely through the stationary units 54 and 55. By suspending the shaft 61 between the diaphragms 58 and 59 friction is eliminated. The diaphragm 58 and 59 can be made of flexible material like rubber, polyurethane or steel. All the main components of this speaker are similar to those of the loudspeaker in FIG. 7 and therefore will not be described again. The bi-directional speaker according to this invention can be used in open air environment. The advantage is the elimination of phase(anti-phase) noises, created by the interference between microphones and the backstage control speakers that are facing them.

Another advantage is that it can be used underwater at any depth for communication between divers or between submarines. It can be used also in a "black box" device for locating sunken ships. In this speaker design the water pressure acts equally upon the diaphragms 58 and 59, from opposed direction canceling itself. As a result the necessary force to produce sounds is independent of the water pressure. The same process is found in nature as used by marine animals. This speaker can be made very small and water resistant.

What is claimed is:

1. An electromagnetic drive comprising:

a stationary unit having a coil means and a stationary magnet means, the magnet means being coaxially attached to a lateral face of said coil means; a mobile unit centered and coaxially placed with respect to said stationary unit, the mobile unit having a mobile magnet means fastened to a linear motion executing means so as to hold and linearly guide the mobile magnet means and further to transfer the linear motion of said mobile unit; an enclosing assembly engaged with the stationary unit and said mobile unit for support and protection thereof;

said enclosing assembly comprises a main housing including an end cover at each end thereof in support of said stationary unit, and wherein the linear motion executing means is a shaft said shaft being supported in sliding motion by the main housing and further providing support for a spring engaged for urging said mobile magnet toward said stationary magnet means.

2. An electromagnetic drive as claimed in claim 1 wherein said stationary magnet means and the mobile magnet means are annular permanent magnets magnetized in the direction of thickness of the annulus, aligned and arranged with their magnetic polarities in such a manner to repulse each other.

3. An electromagnetic drive as claimed in claim 1 wherein said coil is energized by a chopped direct current polarized in such a way as to add its magnetic flux to the stationary magnet flux, to further repulse said mobile magnet.

4. An electromagnetic drive as claimed in claim 2 wherein two of said stationary units are aligned and facing each other including between them said mobile unit, having both said coils connected in series in such a way that their magnetic fluxes are opposed when energized.

5. An electromagnetic drive as claimed in claim 4 wherein said shaft of said mobile unit is extended away from both sides of said mobile magnet.

6. An electromagnetic drive as claimed in claim 4 wherein said bobbin includes a hollow area and said stationary magnet includes a hole to allow unobstructed passage for said shaft.

7. An electromagnetic drive as claimed in claim 4 wherein said end covers provides support and alignment for both said stationary units, having also a bearing area to allow said shaft to slide through the bearing area.

8. An electromagnetic drive as claimed in claim 4 wherein said stationary magnets and said mobile magnet are annular permanent magnets magnetized in the direction of thickness of the annulus, aligned and arranged in a way that the magnetic polarity of said stationary magnets will repulse said mobile magnet from both directions centering it in the middle between them.

9. An electromagnetic drive as claimed in claim 4 wherein all other elements excluding said permanent magnets are made of diamagnetic material.

10. An electromagnetic drive as claimed in claim 4 wherein the magnetic flux of said coil when energized is strong enough to overcome the magnetic flux of said stationary magnet.

11. An electromagnetic drive as claimed in claim 4 wherein said coil when energized by bi-directional rectangular current creates a magnetic flux which when added to the magnetic flux of said stationary magnet repulses said mobile magnet toward the second said coil, the second coil attracting said mobile magnet and overcomes the repulsive force generated by said stationary magnet.

12. An electromagnetic drive as claimed in claim 11 wherein the motion of the mobile unit is controllable by varying the positive and negative time periods of a constant critical frequency of the bi-directional rectangular current through the stationary coils.

13. An electromagnetic drive as claimed in claim 4 wherein said mobile unit has said shaft replaced by an elastic means to hold and align said mobile magnet further fastened to a diaphragm of a loudspeaker.

14. An electromagnetic drive as claimed in claim 13 wherein said housing has supporting and positioning means for said stationary unit furthermore connected to a spoked frame which has supporting and positioning means for the second said stationary unit.

15. An electromagnetic drive as claimed in claim 13 wherein said stationary units and said mobile unit are positioned on one side of said diaphragm of said loudspeaker.

16. An electromagnetic drive as claimed in claim 15 wherein said mobile unit has said shaft attached to said diaphragm at one end and is further supported and positioned by a bearing area at the other end.

17. An electromagnetic drive as claimed in claim 1 wherein said stationary unit and said mobile unit are positioned between a pair of diaphragms of a bi-directional speaker.

18. An electromagnetic drive as claimed in claim 17 wherein said mobile unit has said shaft means moving freely through said stationary units the shaft means being supported and aligned by said pair of diaphragms whereby friction forces are reduced and underwater operation is enabled.

* * * * *